US007621772B1

(12) United States Patent
Tobey

(10) Patent No.: US 7,621,772 B1
(45) Date of Patent: Nov. 24, 2009

(54) ELECTRICAL CONNECTOR WITH A COMPLIANT CABLE STRAIN RELIEF ELEMENT

(75) Inventor: Shawn Phillip Tobey, Trinity, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/143,291

(22) Filed: Jun. 20, 2008

(51) Int. Cl.
*H01R 13/58* (2006.01)

(52) U.S. Cl. ..... 439/460; 174/660

(58) Field of Classification Search ..... 439/460, 439/470, 461–465, 676, 450, 459; 174/660
See application file for complete search history.

(56) References Cited

U.S. PATENT DOCUMENTS 1,725,883 A * 8/1929 Recker ..... 285/154.2
1,830,250 A * 11/1931 Tiefenbacher ..... 285/154.2
3,858,151 A * 12/1974 Paskert ..... 439/98
4,441,776 A * 4/1984 Anhalt ..... 439/347
4,711,507 A * 12/1987 Noorily ..... 439/292
4,737,118 A * 4/1988 Lockard ..... 439/295
5,445,538 A * 8/1995 Rodrigues et al. ..... 439/460
5,732,984 A * 3/1998 Bartholomew ..... 285/319
5,866,853 A * 2/1999 Sheehan ..... 174/653
6,056,586 A * 5/2000 Lin ..... 439/460
6,142,828 A 11/2000 Pepe
6,238,231 B1 * 5/2001 Chapman et al. ..... 439/404
6,422,884 B1 * 7/2002 Babasick et al. ..... 439/222
6,582,248 B2 * 6/2003 Bachman ..... 439/462
6,872,886 B2 * 3/2005 Kiely ..... 174/656
6,953,362 B2 * 10/2005 Mossner et al. ..... 439/395
7,384,298 B2 * 6/2008 Caveney et al. ..... 439/404
7,401,402 B2 * 7/2008 Bresche et al. ..... 29/842
7,404,739 B2 * 7/2008 Sheilds et al. ..... 439/608
7,432,452 B2 * 10/2008 Gardner ..... 174/650
2001/0027043 A1 * 10/2001 Shiraki et al. ..... 439/188
2002/0155746 A1 * 10/2002 Simpson ..... 439/357
2003/0100215 A1 * 5/2003 Bachman ..... 439/462
2005/0202697 A1 * 9/2005 Caveney et al. ..... 439/77
2007/0141908 A1 * 6/2007 Bert et al. ..... 439/608
2007/0240902 A1 * 10/2007 Tapper ..... 174/660
2007/0278006 A1 * 12/2007 Gardner ..... 174/659

* cited by examiner

*Primary Examiner*—T C Patel
*Assistant Examiner*—Harshad C Patel

(57) ABSTRACT

An electrical connector includes a wire termination sub-assembly having a housing holding a plurality of contacts at a wire termination end of the housing. The contacts are configured to be electrically coupled to wires of a cable. The wire termination sub-assembly further includes a strain relief element coupled to the housing. The strain relief element includes an end wall having an opening therein, and the strain relief element includes a flexible beam extending axially inward from the opening. The flexible beam is configured to engage the cable.

18 Claims, 7 Drawing Sheets

ELECTRICAL CONNECTOR WITH A COMPLIANT CABLE STRAIN RELIEF ELEMENT

BACKGROUND OF THE INVENTION

The subject matter herein relates generally to electrical connectors, and more particularly to electrical connectors having compliant cable strain relief elements.

Various electronic systems, such as those used to transmit signals in the telecommunications industry, include connector assemblies with electrical wires arranged in differential pairs. One wire in the differential pair carries a positive signal and the other wire carries a negative signal intended to have the same absolute magnitude, but at an opposite polarity.

An RJ-45 electrical connector is one example of a connector used to transmit electrical signals in differential pairs. The electrical connector may either be a plug or an outlet jack that is terminated to the end of a cable having individual wires. Typically, the electrical connector includes a cable strain relief to relieve stress on the wires terminated within the electrical connector. The cable strain relief is typically an overmolded portion at the interface of the cable and the electrical connector. The additional step of providing the overmolded strain relief can add cost to the overall connector in terms of both time and material.

In an attempt to avoid that added cost and complexity of overmolding the strain relief, at least some known connector assemblies include an end wall having an opening through which the cable passes. The opening serves as a bend limiting feature that resists bending of the cable. However, such designs provide little strain relief. Additionally, to be effective, the size of the opening needs to be closely matched to the diameter of the cable to provide adequate bend limiting. As such, many different components with different sized openings need to be provided to accommodate a range of cable sizes.

A need remains for an electrical connector that may provide cable strain relief in a cost effective and reliable manner. A need remains for a cable strain relief that may accommodate cables having different diameters. A need remains for a cable strain relief that maintains a normal force on the cable to hold the cable in position with respect to the electrical connector.

BRIEF DESCRIPTION OF THE INVENTION

In one embodiment, an electrical connector is provided that includes a wire termination sub-assembly having a housing holding a plurality of contacts at a wire termination end of the housing. The contacts are configured to be electrically coupled to wires of a cable. The wire termination sub-assembly further includes a strain relief element coupled to the housing. The strain relief element includes an end wall having an opening therein, and the strain relief element includes a flexible beam extending axially inward from the opening. The flexible beam is configured to engage the cable.

Optionally, the flexible beam may extend between a fixed end and free end, where the flexible beam is flexed about the fixed end to provide a normal force on the cable. The flexible beam may have a retention feature extending radially inward from the flexible beam, wherein the retention feature engages the cable. The retention feature may be approximately centered between the fixed end and the free end. Optionally, the strain relief element may include a boss extending rearward from the end wall, with the boss defining a channel therethrough for receiving the cable and with the opening providing access to the channel. The flexible beam may extend along the radially inner surface of the boss. Optionally, the strain relief element may include a plurality of ribs extending axially inward from the opening, wherein at least one rib is positioned on either side of the flexible beam, the ribs and flexible beam cooperating to hold the cable.

Optionally, the housing or the strain relief element may include a rail that correspond with the flexible beam. The rail may be positioned radially outward with respect to the corresponding flexible beam, wherein the rail defines a flex limit for the flexible beam when the flexible beam engages the rail. The strain relief element may include a boss extending outward from the end wall, wherein the rail and the flexible beam extends from a distal end of the boss to a proximal end of the boss that is substantially aligned with the end wall. The housing may include walls defining a chamber extending inward from the wire termination end, wherein the rail extends along the walls defining the chamber. The flexible beam may extend from the end wall into the chamber along the rail.

In another embodiment, an electrical connector is provided that includes a jack housing having a mating end and a wire terminating end, a contact sub-assembly received in the jack housing having a plurality of jack contacts mounted to a substrate, and a wire termination sub-assembly coupled to the wire termination end of the housing. The wire termination sub-assembly has a housing holding a plurality of contacts that are configured to be electrically coupled to the jack contacts and to wires of a cable. The wire termination sub-assembly further has a strain relief element coupled to the housing with the strain relief element including an end wall having an opening therein. The strain relief element also including a plurality of flexible beams extending axially inward from the opening, wherein the flexible beams are configured to engage the cable.

In a further embodiment, an electrical connector is provided including a housing and a cable strain relief coupled to the housing. The cable strain relief includes an end wall having an outer surface and an inner surface generally facing the housing and the end wall includes an opening therethrough configured to receive a cable. The cable strain relief has a plurality of flexible beams circumferentially spaced around the opening and extending axially from the opening.

DETAILED DESCRIPTION OF THE INVENTION

Figure 1:
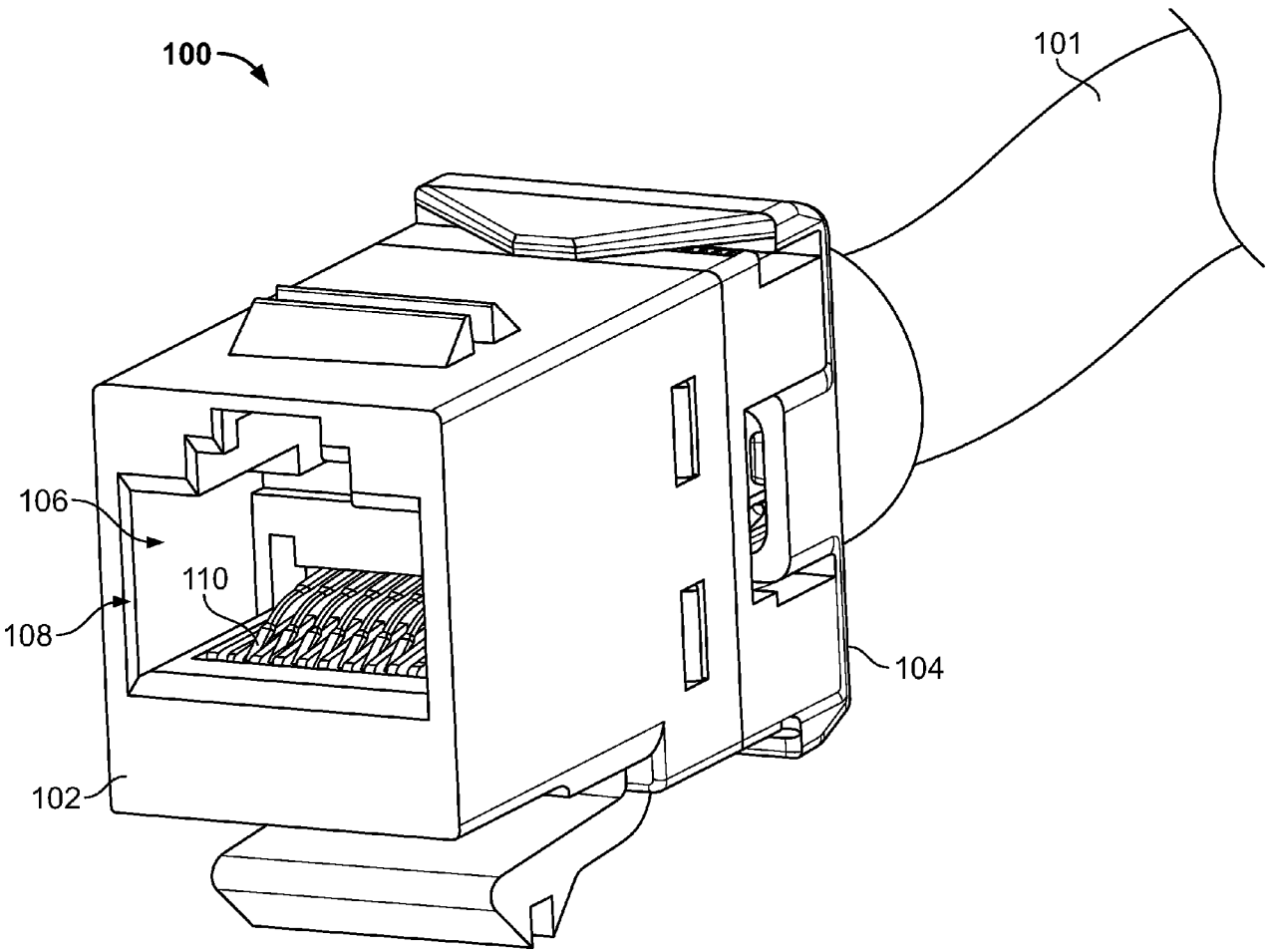
FIG. 1 is a front perspective view of an electrical connector formed in accordance with an exemplary embodiment.

FIG. 1 is a front perspective view of an electrical connector 100 formed in accordance with an exemplary embodiment. The electrical connector 100 is illustrated as an RJ-45 jack or receptacle, however the subject matter described herein may be used with other types of electrical connectors. The RJ-45 jack is thus merely illustrative. The electrical connector 100 is provided at the end of a cable 101. In an exemplary embodiment, the cable 101 includes multiple wires, arranged in differential pairs, such as in a twisted wire pair configuration.

The electrical connector 100 has a front or mating end 102 and a wire termination end 104. A mating cavity 106 is provided at the mating end 102 and is configured to receive a mating connector (not shown) therein. A mating end opening 108 is also provided at the mating end 102 that provides access to the mating cavity 106. Jack contacts 110 are arranged within the mating cavity 106 in an array for mating engagement with mating contacts (not shown) of the mating connector. In the example of FIG. 1, the mating cavity 106 accepts an RJ-45 plug (not shown) inserted through the mating end opening 108. The RJ-45 plug has mating contacts which electrically interface with the array of jack contacts 110.

Figure 2:
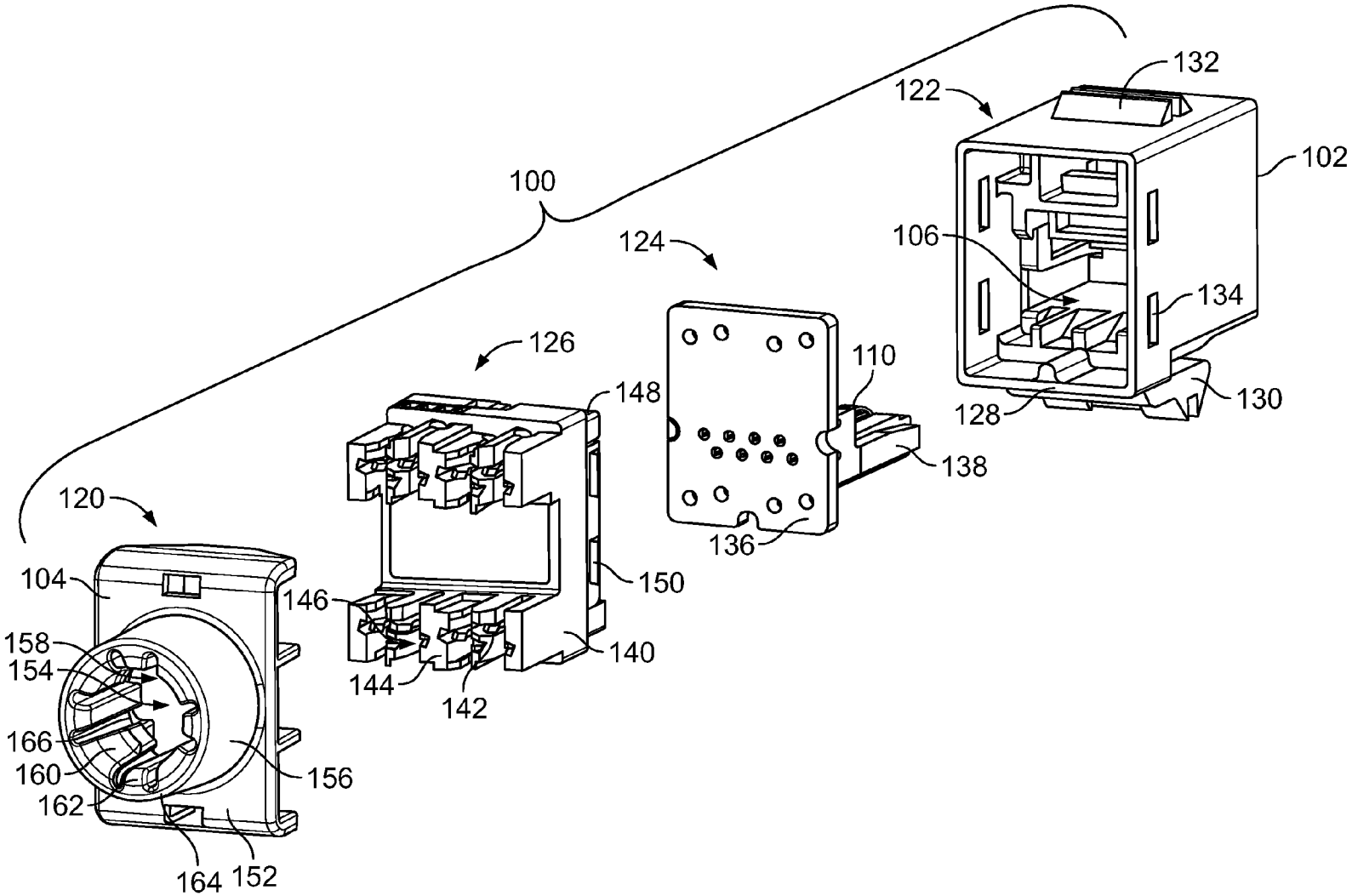
FIG. 2 is an exploded view of the electrical connector shown in FIG. 1 illustrating a cable strain relief element.

FIG. 2 is an exploded view of the electrical connector 100 illustrating a cable strain relief element 120. The electrical connector 100 includes a jack housing 122, a contact sub-assembly 124 and a wire termination sub-assembly 126. The contact sub-assembly 124 is loaded into the jack housing 122 and the wire termination sub-assembly 126 is coupled to the jack housing 122.

The jack housing 122 is generally box-shaped, however the jack housing 122 may have any shape depending on the particular application. The jack housing 122 extends between the front end 102 and a rear end 128. The mating cavity 106 extends at least partially between the front and rear ends 102, 128. The jack housing 122 is fabricated from a dielectric material, such as a plastic material. Alternatively, the jack housing 122 may be shielded, such as by being fabricated by a metal material or a metalized plastic material, or by having a shield element. In one embodiment, the jack housing 122 includes latches 130, 132 for mounting to a wall panel. The jack housing 122 also includes slots 134 in side walls of the jack housing 122.

The contact sub-assembly 124 includes a substrate 136, such as a circuit board, and a tray 138 extending from one side of the substrate 136. The jack contacts 110 are mounted to the substrate 136 and are supported by the tray 138. Optionally, the jack contacts 110 may include pins that are through-hole mounted to the substrate 136. Alternatively, the jack contacts 110 may be soldered to the substrate 136 or the jack contacts 110 may be supported by the substrate 136 for direct mating with the wires of the cables or with other contacts. The contact sub-assembly 124 is received in the jack housing 122 such that the jack contacts 110 are presented at the mating cavity 106.

The wire termination sub-assembly 126 includes a wire termination housing 140 that holds a plurality of wire termination contacts 142 in respective contact towers 144. The contact towers 144 extend from a rear end of the housing 140 and include slots 146 that receive the wires of the cable 101 (shown in FIG. 1). The contacts 142 are illustrated as being insulation displacement contacts, however any type of contacts may be provided for terminating to the individual wires of the cable 101. The contacts 142 are configured to be electrically and mechanically coupled to the substrate 136 of the contact sub-assembly 124 when the electrical connector 100 is assembled. For example, the contacts 142 may include pins that project from a mating end 148 of the housing 140 and that are received in through-holes in the substrate 136. Optionally, traces routed along the substrate 136 may connect the contacts 142 with the jack contacts 110. The contacts 142 may be press-fit or soldered to the through-holes in the substrate 136. When assembled, the wire termination sub-assembly 126 is coupled to the rear end 128 of the jack housing 122. In an exemplary embodiment, the housing 140 includes tabs 150 on the sides of the housing 140 that are received in the slots 134 in the jack housing 122 to secure the wire termination sub-assembly 126 to the jack housing 122.

The strain relief element 120 is coupled to the housing 140 and is configured to hold the cable 101 (shown in FIG. 1) and/or the associated wires of the cable 101. The strain relief element 120 includes an end wall 152 that defines the wire termination end 104 of the electrical connector 100. When the electrical connector 100 is assembled, the strain relief element 120 defines an end cap at the wire termination end 104. The strain relief element 120 also includes an opening 154 extending therethrough that is configured to receive the cable 101. The opening 154 extends transversely through the end wall 152.

In an exemplary embodiment, the strain relief element 120 includes a boss 156 extending rearward from the end wall 152. The boss 156 defines a channel 158 extending therethrough. A plurality of flexible beams 160 and a plurality of ribs 162 extend axially along, and inward into, the channel 158 from the boss 156. FIG. 2 illustrates four flexible beams 160 and four ribs 162 positioned between adjacent ones of the flexible beams 160. Other embodiments, may have any number of flexible beams 160 and ribs 162, including just a single beam 160 and/or a single rib 162. Optionally, the strain relief element 120 may not include any beams 160. In an exemplary embodiment, the channel 158 extends between a distal end 164 and a proximal end 166 that is substantially aligned with the end wall 152. The distal end 164 is provided a distance from the proximal end 166 and/or the end wall 152. The opening 154 is defined at the distal end 164 of the boss 156. The flexible beams 160 and ribs 162 extend at least partially between the distal end 164 and the proximal end 166. In an exemplary embodiment, the flexible beams 160 and ribs 162 extend from the distal end 164 to the proximal end 166. The flexible beams 160 and the ribs 162 cooperate to engage and/or hold the cable 101 within the strain relief element 120. The flexible beams 160 and the ribs 162 may reduce stresses on the wires due to bending or other movement of the cable 101.

Figure 3:
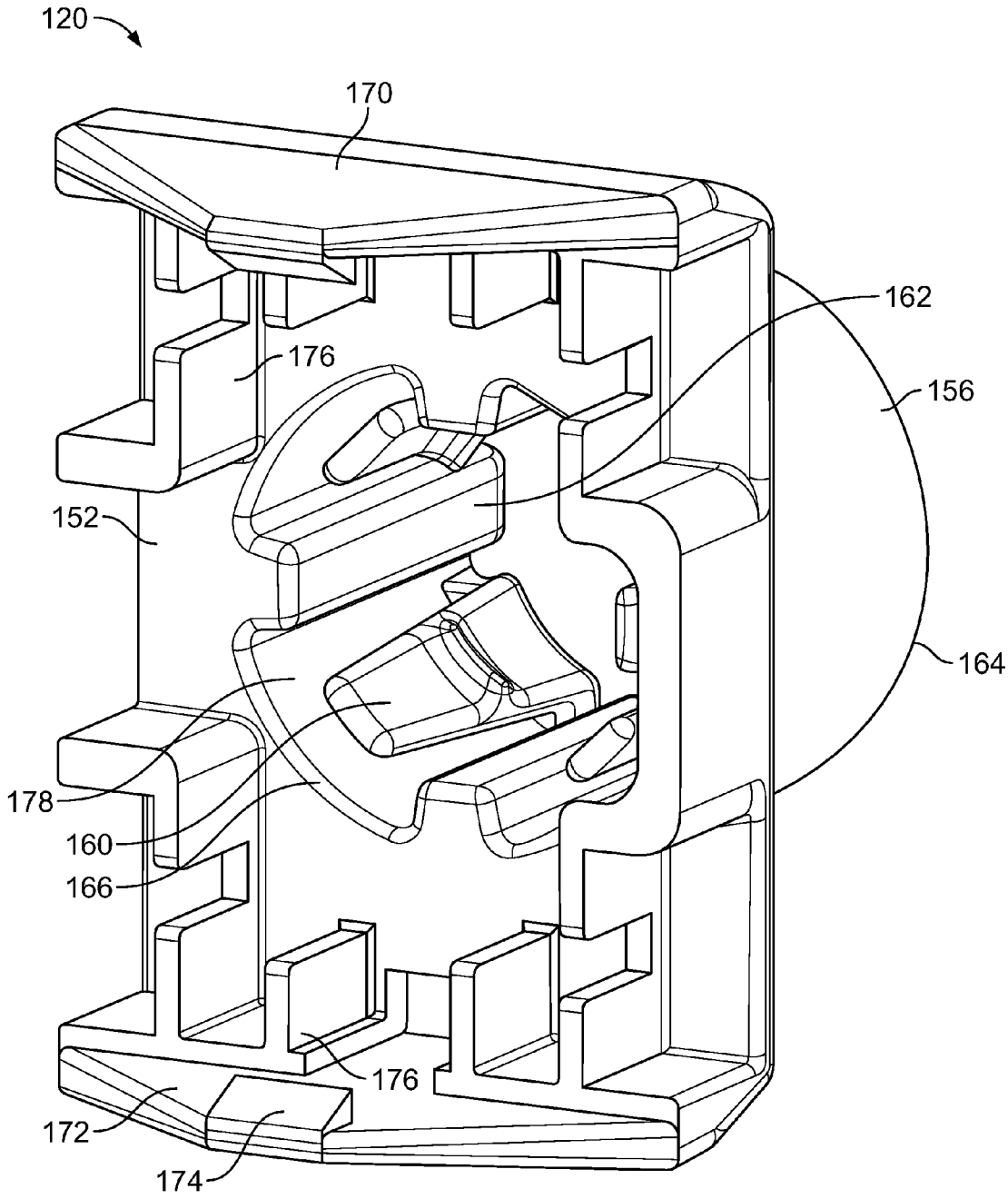
FIG. 3 is a perspective view of the strain relief element shown in FIG. 2.

FIG. 3 is a perspective view of the interior side of the strain relief element 120. The strain relief element 120 includes the end wall 152 and top and bottom walls 170, 172. Tabs 174 are provided on the top and bottom walls 170, 172 for mounting to the housing 140 (shown in FIG. 2). A plurality of inner walls 176 are provided on the interior side of the strain relief element 120. Optionally, the inner walls 176 may be sized, shaped and positioned to complement the housing 140 of the wire termination sub-assembly 126 (shown in FIG. 2), such as by fitting between and/or around the contact towers 144 (shown in FIG. 2). Optionally, the inner walls 176 may be used to organize and/or position the wires of the cable 101 (shown in FIG. 1) during assembly of the strain relief element 120 with the housing 140. For example, the wires may be laced around and/or through the inner walls 176 such that the wires are properly positioned for mating with the contacts 142 during assembly of the strain relief element 120 with the housing 140.

The ribs 162 are illustrated in FIG. 3 as extending along the boss 156 to the end of the channel 158. The ribs 162 extend axially along the boss 156. In an exemplary embodiment, rails 178 are provided between the ribs 162. The rails 178 define a radially inner surface of the boss 156 and radially outer surface of the channel 158. The rails 178 are defined by the boss 156. The rails 178 extend from the distal end 164 to the proximal end 166 and are positioned radially outward from the flexible beams 160. In other words, the flexible beams 160 are aligned with, and positioned radially inward with respect to, the rails 178.

Figure 4:
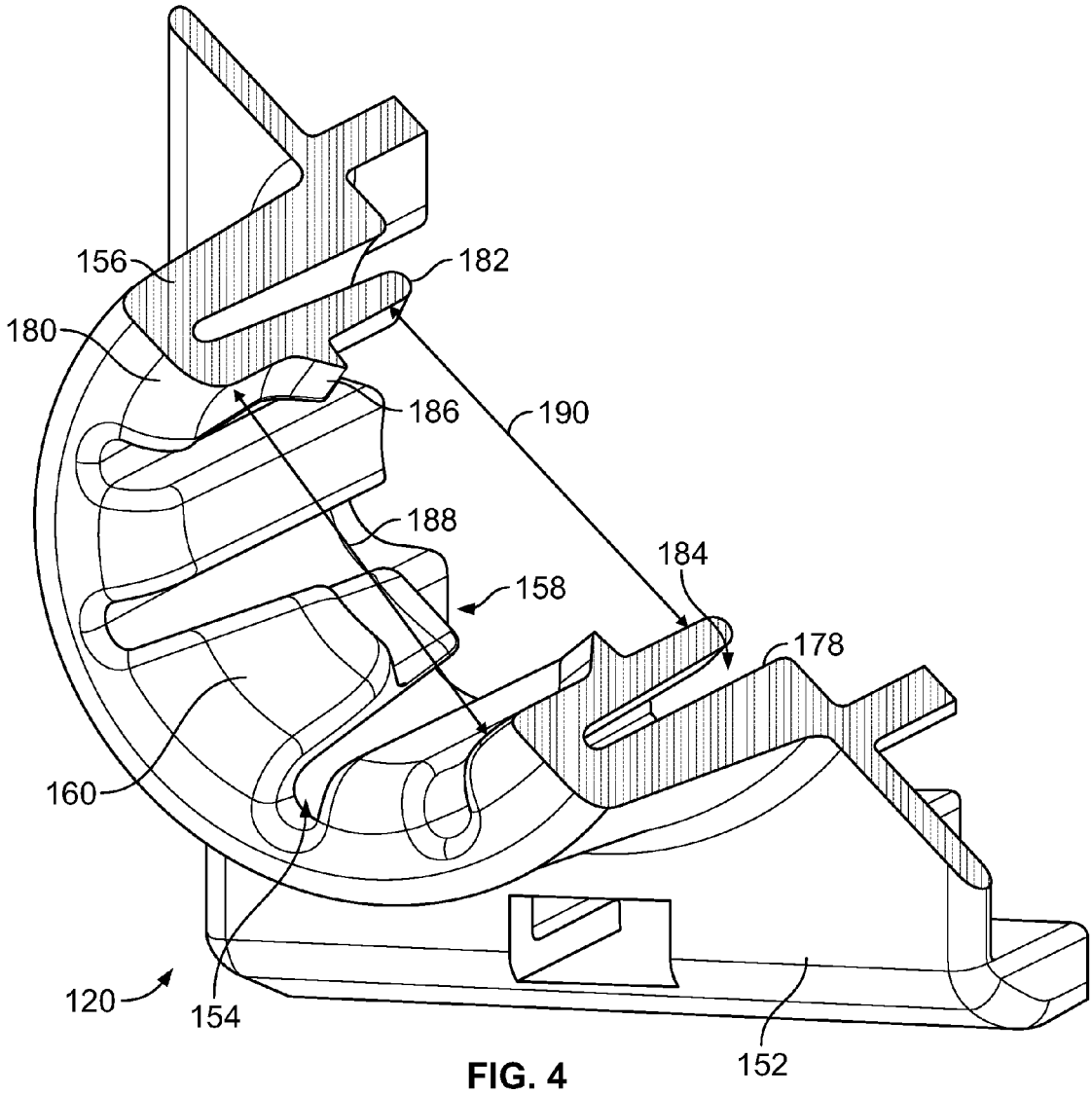
FIG. 4 is a perspective cross-sectional view of the strain relief element showing a plurality of flexible beams.

FIG. 4 is a cross-sectional view of the strain relief element 120 showing a plurality of flexible beams 160. The flexible beams 160 extend between fixed ends 180 and free ends 182. The flexible beams 160 thus define cantilevered beams that are attached to the boss 156 at the fixed ends 180. In the illustrated embodiment, the flexible beams 160 are fixed proximate the opening 154 and the free ends 182 are substantially aligned with the end wall 152. The free ends 182 are generally elevated above the corresponding rails 178 such that a flex space 184 is defined between the flexible beams 160 and the rails 178. When the cable 101 (shown in FIG. 1) is loaded through the opening 154, the flexible beams 160 are flexed outward and engage the cable 101 to hold the cable 101 between the flexible beams 160. The flexing of the flexible beams 160 provides a normal force on the cable 101 in a generally radially inward direction.

In an exemplary embodiment, retention features 186 extend radially inward from the flexible beams 160. The retention features 186 are configured to engage the cable 101 when the cable 101 is loaded into the strain relief element 120. In one embodiment, the retention features 186 are positioned generally centrally along the beams 160, however, the location may be strategically selected to any location along the beam 160. For example, the location of the retention feature 186 may control an amount of normal force on the cable 101 or the location of the retention feature 186 may control an amount of deflection or a rate of deflection of the beam 160. The size and/or shape of the retention feature 186 may control an amount of deflection or a rate of deflection of the beam 160.

Optionally, the flexible beams 160 may be integrally formed with the boss 156 and/or the strain relief element 120. For example, the strain relief element 120 may be a molded plastic material. In some embodiments, the strain relief element 120 may be coated or plated or otherwise fabricated from a conductive material to provide shielding and the flexible beams 160 may engage a shield or cable braid of the cable 101 to provide a ground path between the cable 101 and the strain relief element 120.

In an exemplary embodiment, an even number of flexible beams 160 are provided and the flexible beams 160 are circumferentially spaced apart from one another around the channel 158. Each flexible beam 160 may have a complimentary flexible beam 160 directly opposite therefrom that together define a beam set (e.g. the flexible beams 160 shown in cross-section in FIG. 4). The flexible beams 160 of the beam set provide opposite normal forces on the cable 101. The flexible beams 160 of a beam set are separated from one another by a fixed end distance 188 between the fixed ends 180. The flexible beams 160 of a beam set are separated from one another by a free end distance 190 between the free ends 182. The distances 188, 190 may be the same as one another or may be different from one another. The fixed end distance 188 is fixed and does not change upon loading or movement of the cable 101. The free end distance 190 is changeable as the cable 101 is loaded into the channel 158 by flexing the flexible beams 160 outward.

Figure 5:
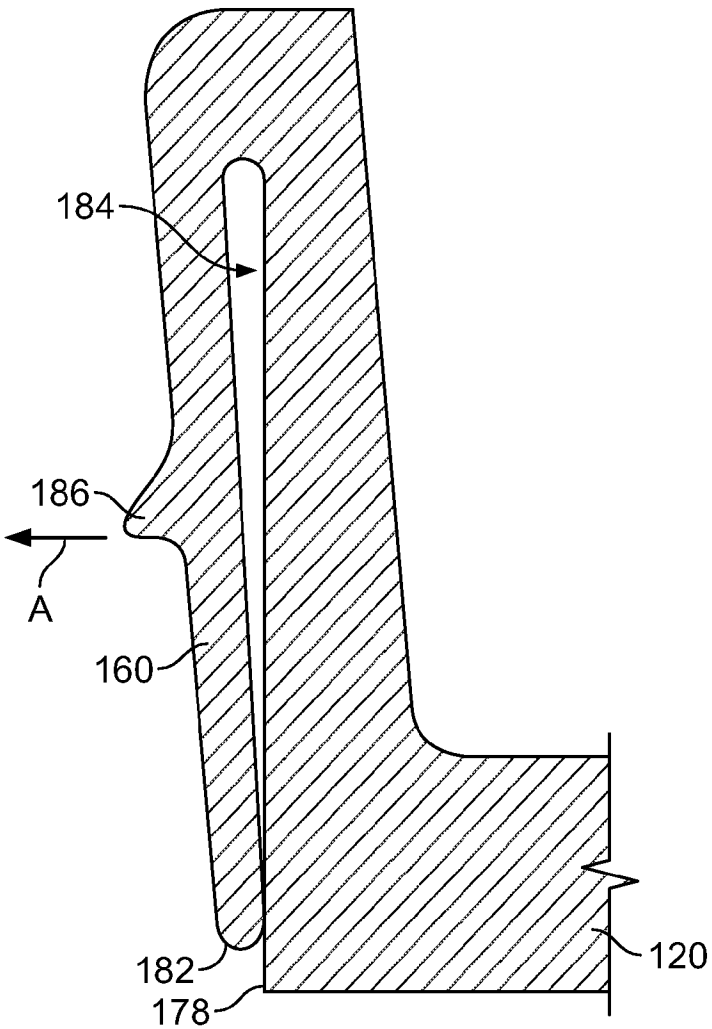
FIG. 5 is a cross-sectional view of the strain relief element illustrating the flexible beam in an un-deflected and a deflected state.
Figure 5:
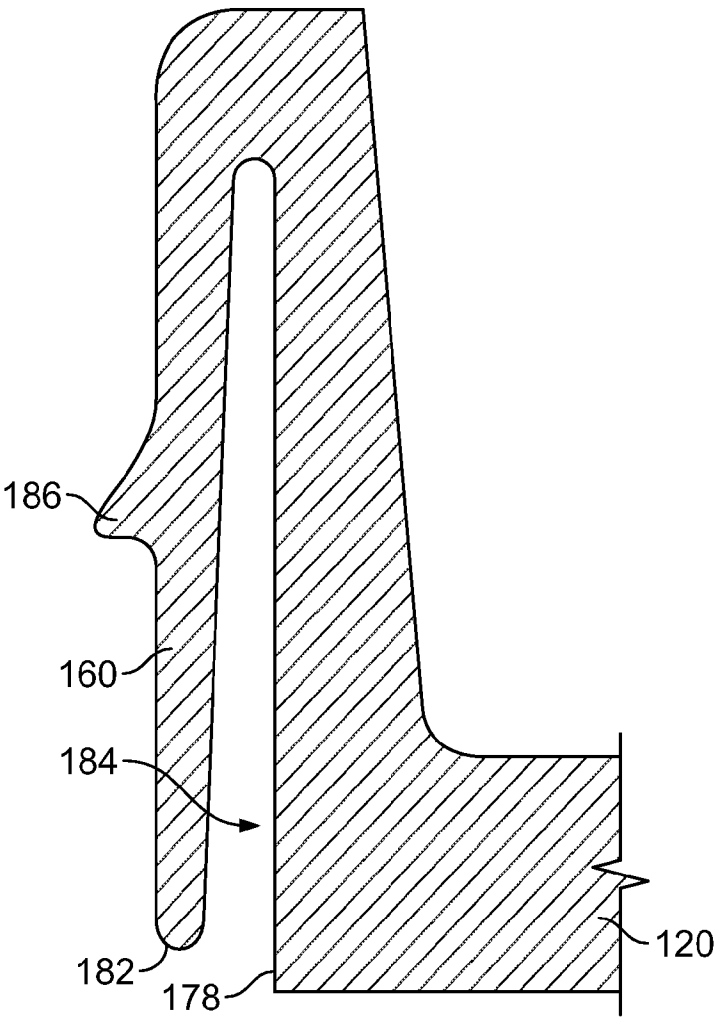

FIG. 5 is a cross-sectional partial view of the strain relief element 120 illustrating the flexible beam 160 in an un-deflected state (e.g. the left view in FIG. 5) and a deflected state (e.g. the right view in FIG. 5). The flexible beam 160 may be transferred to the deflected state when the cable 101 (shown in FIG. 1) is loaded into the strain relief element 120. As the cable 101 engages the flexible beam 160 and/or the retention feature 186, the free end 182 of the flexible beam 160 is pushed generally toward the rail 178. The diameter of the cable 101 is one factor that determines how much the flexible beam 160 deflects. As the flexible beam 160 is deflected, the beam 160 begins to fill the flex space 184. As the beam 160 is deflected, the beam 160 imparts a normal force on the cable 101 in a direction generally away from the beam 160, such as the direction of arrow A illustrated in FIG. 5.

In the deflected state, the flexible beam 160 may engage the rail 178 which defines a flex limit, however, the amount of deflection may be less than the amount needed to engage the rail 178, depending on the size of the cable 101. When the flexible beam 160 engages the rail 178, the beam 160 defines a simply supported beam as opposed to a cantilevered beam. As a simply supported beam, the beam 160 may function differently than a cantilevered beam. For example, the normal force imparted on the cable 101 may be different. For example, for a given amount of deflection at the retention feature 186, the normal force imparted on the cable 101 by the beam 160 as a cantilevered beam is less than the normal force imparted on the cable 101 by the beam 160 as a simply supported beam. After the beam 160 engages the rail 178, further deflection of the beam 160 deflects the beam 160 generally at the center of the beam 160, such as proximate to the retention feature 186.

Figure 6:
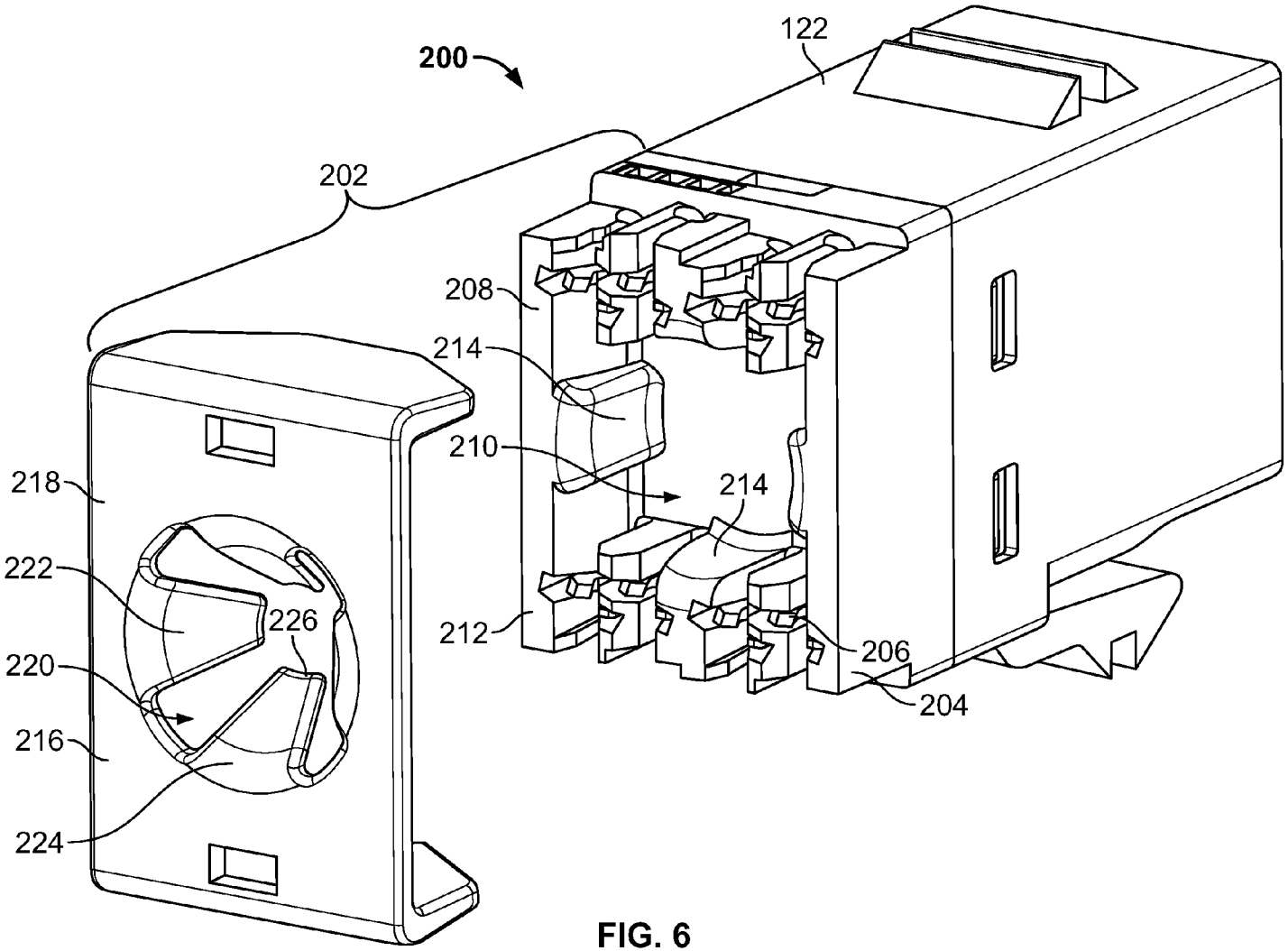
FIG. 6 is a rear exploded perspective view of an alternative electrical connector.

FIG. 6 is a rear perspective exploded view of an alternative electrical connector 200. The electrical connector 200 is similar to the electrical connector 100 in some respects, and like components are identified with like reference numerals. The electrical connector 200 includes a wire termination sub-assembly 202 coupled to the jack housing 122.

The wire termination sub-assembly 202 includes a housing 204 holding a plurality of contacts 206. The housing 204 includes a plurality of walls 208 defining a chamber 210 extending inward from a wire termination end 212. The walls 208 include a plurality of rails 214 that extend along the walls 208. In the illustrated embodiment, four rails 214 are provided. Optionally, the rails 214 may be curved.

The wire termination sub-assembly 202 also includes a strain relief element 216. The strain relief element 216 includes an end wall 218 and an opening 220 extending therethrough. A plurality of flexible beams 222 extend inward from the end wall 218 at the opening 220. The flexible beams 222 include fixed ends 224 and free ends 226. The beams 222 may be rotated radially outward about the fixed ends 224 when a cable is inserted through the opening 220. The beams 222 impart a normal force on the cable when inserted therethrough. In an exemplary embodiment, when the strain relief element 216 is coupled to the housing 204, the beams 222 are substantially aligned with the rails 214. The beams 222 may be deflected until the free ends 226 engage the rails 214, and in some embodiments may be further deflected even after the free ends 226 engage the rails 214, such as by deflecting the center portion of the beams 222 outward.

Figure 7:
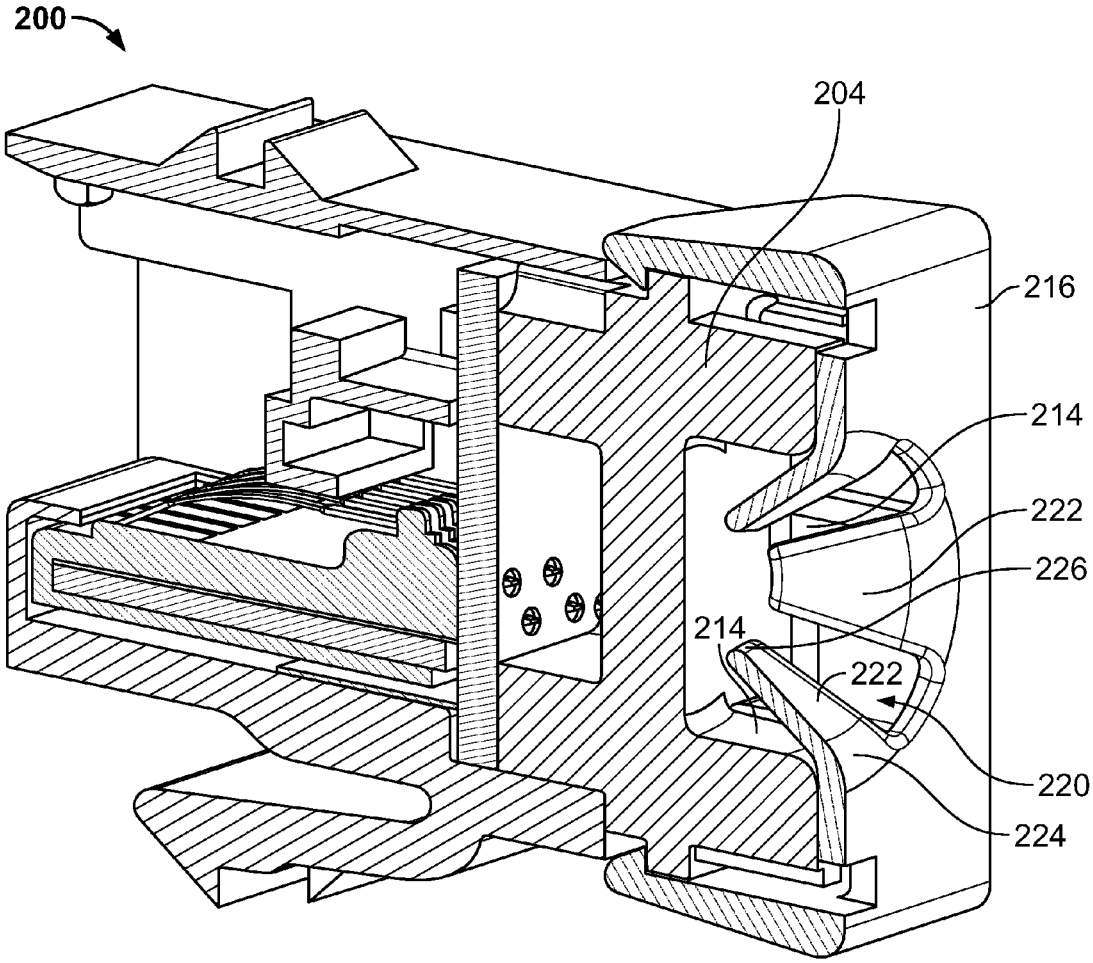
FIG. 7 is a cross-sectional view of the assembled electrical connector shown in FIG. 6.

FIG. 7 is a cross-sectional view of the assembled electrical connector 200. FIG. 7 illustrates the strain relief element 216 coupled to the housing 204. The flexible beams 222 are aligned with the rails 214. In operation, with the cable inserted into the opening 220, the beams 222 are deflected outward toward the rails 214, which define flex limits for the free ends 226 of the beams 222. During assembly, the cable is inserted into the strain relief element 216 prior to coupling the strain relief element 216 to the housing 204.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector comprising:

a wire termination sub-assembly comprising a housing holding a plurality of contacts at a wire termination end of the housing, the contacts being configured to be electrically coupled to wires of a cable, the wire termination sub-assembly further comprising a strain relief element coupled to the housing, the strain relief element including an end wall having an opening therein, the strain relief element including a flexible beam extending axially inward from the opening, the flexible beam being configured to engage the cable;

wherein one of the housing and the strain relief element includes a rail that corresponds with the flexible beam, the rail being positioned radially outward with respect to the corresponding flexible beam, wherein the rail defines a flex limit for the flexible beam when the flexible beam engages the rail.

2. The electrical connector of claim 1, wherein the flexible beam extends between a fixed end and a free end, the flexible beam being flexed about the fixed end to provide a normal force on the cable.

3. The electrical connector of claim 1, wherein the flexible beam extends between a fixed end and a free end, the flexible beam having a retention feature extending radially inward from the flexible beam, the retention feature engaging the cable, the retention feature being approximately centered between the fixed end and the free end.

4. The electrical connector of claim 1, wherein the strain relief element further includes a boss extending rearward from the end wall, the boss defining a channel therethrough for receiving the cable with the opening providing access to the channel, the flexible beam extending along the radially inner surface of the boss.

5. The electrical connector of claim 1, wherein the strain relief element further includes a boss extending rearward from the end wall, the rail and the flexible beam extend from a distal end of the boss to a proximal end of the boss that is substantially aligned with the end wall.

6. The electrical connector of claim 1, wherein the housing includes walls defining a chamber extending inward from the wire termination end, the rail extends along the walls defining the chamber, the flexible beam extends from the end wall into the chamber along the rail.

7. The electrical connector of claim 1, wherein the strain relief element further includes a plurality of ribs extending axially inward from the opening, wherein at least one rib is positioned on either side of the flexible beam, the ribs and flexible beam cooperating to hold the cable.

8. The electrical connector of claim 1, wherein the flexible beam extends between a fixed end and a free end, wherein the flexible beam is flexed about the fixed end until the free end engages a supporting structure, the flexible beam imparting a first normal force on the cable when the flexible beam defines a cantilevered beam and the flexible beam imparting a second normal force on the cable when the flexible beam defines a simply supported beam, the second normal force being different than the first normal force.

9. The electrical connector of claim 1, wherein the strain relief element includes a plurality of flexible beams, each flexible beam includes a complimentary beam directly opposite therefrom that together define a beam set, the flexible beams of the beam set providing opposite normal forces on the cable.

10. An electrical connector comprising:

a jack housing having a mating end and a wire terminating end;

a contact sub-assembly received in the jack housing, the contact sub-assembly having a plurality of jack contacts mounted to a substrate; and a wire termination sub-assembly coupled to the wire termination end of the housing, the wire termination sub-assembly having a housing holding a plurality of contacts that are configured to be electrically coupled to the jack contacts and to wires of a cable, the wire termination sub-assembly further having a strain relief element coupled to the housing, the strain relief element including an end wall having an opening therein, the strain relief element including a plurality of flexible beams extending axially inward from the opening, the flexible beams being configured to engage the cable.

11. The electrical connector of claim 10, wherein the flexible beams extend between fixed ends and free ends, the flexible beams having retention features extending radially inward from the flexible beams, the retention features engaging and holding the cable, the retention features being approximately centered between the fixed ends and the free ends.

12. The electrical connector of claim 10, wherein one of the housing and the strain relief element includes a plurality of rails that correspond with the plurality of flexible beams, the rails being positioned radially outward with respect to the corresponding flexible beams, wherein the rails define a flex limit for the flexible beams when the flexible beams engage the rails.

13. The electrical connector of claim 10, wherein the contacts of the wire termination sub-assembly are configured to be electrically and mechanically connected to the substrate of the contact sub-assembly, the substrate including traces thereon that electrically interconnect the contacts with the jack contacts.

14. The electrical connector of claim 10, wherein the jack housing includes a mating cavity being configured to receive a mating connector therein and a mating end opening at the mating end providing access to the mating cavity, the jack contacts being arranged within the mating cavity for mating engagement with mating contacts of the mating connector.

15. An electrical connector comprising:

a housing; and a cable strain relief coupled to the housing, the cable strain relief including an end wall having an outer surface and an inner surface generally facing the housing, the end wall includes an opening therethrough configured to receive a cable, the cable strain relief having a plurality of flexible beams circumferentially spaced around the opening and extending axially from the opening, each of the flexible beams having a retention feature extending radially inward from the flexible beams, the retention feature configured to engage and hold the cable, wherein the strain relief element further includes a boss extending outward from the end wall, the boss defining a channel therethrough for receiving the cable with the opening providing access to the channel, the flexible beams extending along the radially inner surface of the boss.

16. The electrical connector of claim 15, wherein the flexible beams extend between fixed ends and free ends, the retention features being approximately centered between the fixed ends and the free ends.

17. The electrical connector of claim 15, wherein one of the housing and the strain relief element includes a plurality of rails that correspond with the plurality of flexible beams, the rails being positioned radially outward with respect to the corresponding flexible beams, wherein the rails define a flex limit for the flexible beams when the flexible beams engage the rails.

18. The electrical connector of claim 15, wherein the flexible beams extending between fixed ends and free ends, wherein the flexible beams are flexed about the fixed ends until the free ends engage a supporting structure, the flexible beams imparting a first normal force on the cable when the flexible beams define cantilevered beams and the flexible beams imparting a second normal force on the cable when the flexible beams define simply supported beams, the second normal force being different than the first normal force.

* * * * *